US007213496B2

(12) United States Patent
Perricone

(10) Patent No.: US 7,213,496 B2
(45) Date of Patent: May 8, 2007

(54) ILLUMINATED AIRCRAFT COUNTERMEASURES

(75) Inventor: Nicholas V. Perricone, Madison, CT (US)

(73) Assignee: Perriquest Defense Research Enterprises LLC, Meriden, CT (US)

( * ) Notice: Subject to any disclaimer, the term of this patent is extended or adjusted under 35 U.S.C. 154(b) by 0 days.

(21) Appl. No.: 10/818,232

(22) Filed: Apr. 5, 2004

(65) Prior Publication Data

US 2005/0217465 A1 Oct. 6, 2005

(51) Int. Cl.
*F41H 3/00* (2006.01)

(52) U.S. Cl. ..... 89/1.11

(58) Field of Classification Search ..... 102/505; 342/8, 10; 89/1.11

See application file for complete search history.

(56) References Cited

U.S. PATENT DOCUMENTS

| | | | | |
|---|---|---|---|---|
| 1,718,704 | A * | 6/1929 | Plummer | 114/328 |
| 2,619,303 | A * | 11/1952 | Martin | 244/33 |
| 2,752,594 | A * | 6/1956 | Link et al. | 342/10 |
| 3,150,848 | A * | 9/1964 | Lager | 244/3.16 |
| 3,721,983 | A * | 3/1973 | Sherer | 342/10 |
| 3,878,506 | A * | 4/1975 | Young | 340/953 |
| 3,938,151 | A | 2/1976 | Trenam | 343/18 B |
| 4,570,924 | A | 2/1986 | Connelly | 272/8 P |
| 5,034,847 | A * | 7/1991 | Brain | 362/205 |
| 5,061,929 | A | 10/1991 | Bell | 342/10 |
| 5,092,244 | A | 3/1992 | Giglia | 102/293 |
| 5,424,741 | A | 6/1995 | Genovese | 342/10 |
| 5,795,211 | A | 8/1998 | Carignan et al. | 446/220 |
| 5,820,243 | A | 10/1998 | Chang | 362/62 |
| 5,947,581 | A | 9/1999 | Schrimmer et al. | 362/96 |
| 6,106,135 | A | 8/2000 | Zingale et al. | 362/186 |
| 6,178,865 | B1 | 1/2001 | Roberts | 89/36.01 |
| 6,238,067 | B1 | 5/2001 | Hirsch | 362/352 |
| 6,324,955 | B1 | 12/2001 | Andersson et al. | 89/1.11 |
| 6,390,651 | B2 | 5/2002 | Bertrand | 362/352 |
| 6,477,979 | B1 * | 11/2002 | Sanchez | 116/210 |
| 6,492,931 | B1 | 12/2002 | Blitz | 342/15 |
| 6,523,778 | B2 | 2/2003 | Key et al. | 244/31 |
| 6,570,165 | B1 * | 5/2003 | Engdahl et al. | 250/423 P |
| 2001/0046133 | A1 * | 11/2001 | Ramer et al. | 362/298 |

FOREIGN PATENT DOCUMENTS

GB 2 280 569 A * 2/1995

OTHER PUBLICATIONS

International Search Report for International Patent Application No. PCT/US05/10624, dated Apr. 24, 2006, 8 pages.

* cited by examiner

*Primary Examiner*—Stephen M. Johnson
(74) *Attorney, Agent, or Firm*—Sullivan & Worcester LLP

(57) ABSTRACT

A countermeasure device for negating a guidance seeking system is provided. The countermeasure device includes a membrane defining an internal chamber, a gas disposed in the chamber, and an illuminating device. The illuminating device includes a light source producing energy sufficient to provide a decoy signature detectable by the guidance seeking system and a power supply coupled to the light source. In one embodiment the light source is a light emitting diode. In another embodiment, the light source is a laser diode.

8 Claims, 3 Drawing Sheets

ILLUMINATED AIRCRAFT COUNTERMEASURES

FIELD OF THE INVENTION

This invention relates generally to selected decoys or countermeasure devices for negating or confusing tracking or guidance seeking devices of homing missiles so that they fail to lock on their intended aircraft target.

BACKGROUND OF THE INVENTION

Anti-aircraft missiles have electro-optical guidance seeking devices for tracking an infrared or other wavelength radiation emitted from a targeted aircraft (e.g., heat radiating from an aircraft engine's tailpipe). Conventional military aircraft employ hydrocarbon jells, flares or pyrotechnic compositions to produce a thermal decoy signature to attract an approaching missile away from its intended target. While the duration and intensity of such thermal decoy signatures vary, the purpose is to provide enough cover so that the approaching missile losses its ability to accurately track the intended target at least temporarily as the targeted aircraft is flown out of the line of sight of the missile. One problem with the aforementioned thermal decoys is that as components fall to earth they may still radiate enough heat to ignite material such as, for example, grass, trees and buildings, in the area of impact.

Increasingly, concerns have been raised throughout the world about missile attacks against commercial and other non-military aircraft. Typically, such non-military aircraft do not employ any countermeasures to secure against such attack. Additionally, few commercial, non-military airfields employ any defensive measures to provide cover for aircraft taking off or landing at their facility.

Accordingly, that a need exists for countermeasures that employ safer means of forming thermal decoy signatures and for safe, cost-effective countermeasures that can be employed within both military and non-military environments. The present invention provides a solution to this important need.

BRIEF SUMMARY OF THE PRESENT INVENTION

One aspect of the present invention is directed to a countermeasure device for negating a missile's guidance seeking system, comprising:

a membrane defining an internal chamber;

a gas disposed in said chamber, said gas having a lesser density than air; and an illuminating device including:

a light source producing energy sufficient to provide a decoy signature detectable by said guidance seeking system; and a power supply coupled to said light source.

Another aspect of the present invention is directed to, in the operation of an aircraft having one or more turbojet engines, a method for protecting that aircraft from infrared-seeking missiles; including:

1) detecting the approach of such infrared-seeking missile toward said aircraft;

2) in immediate response to such detection, releasing countermeasures as described above so as to reduce the probability that the guidance system of the missile will lock on to the aircraft.

Another aspect of the present invention is directed, in the operation of an aircraft having one more turbojet engines, a system for protecting that aircraft from infrared-seeking missiles; including:

(a) means for detecting the approach of said missiles toward the aircraft;

(b) one or more of the above-noted countermeasures exhaust to reduce the infrared radiation in each engine; and (c) controller for releasing the countermeasures as described above from the aircraft; said controlling means coupled to detection means (a).

DETAILED DESCRIPTION OF THE INVENTION

The terms "aircraft" and "aircraft having one or more turbojet engines" as used in the present specification and claims refer to any type of aircraft (including both commercial and military aircraft) that has an engine that has an exhaust of sufficient infrared radiation to be tracked by a heat-seeking missile. While turbojet engines are a common type of engine on both commercial and military aircraft, the present invention does not exclude other types of engines that have this same characteristic.

In the operation of a turbojet engine, the exhaust of the turbine in such engines is a source of heat (and thus infrared radiation). The exhaust also emits heated carbonaceous materials, which also carry heat in the infrared signature. Together, the pure heat of the exhaust, these heated carbonaceous materials, and the infrared radiation emitting from the heated engine material itself create an infrared signature of the aircraft. It is this signature that heat-seeking surface-to-air (and also heat-seeking air-to-air) missiles are able to detect and target.

Figure 4:
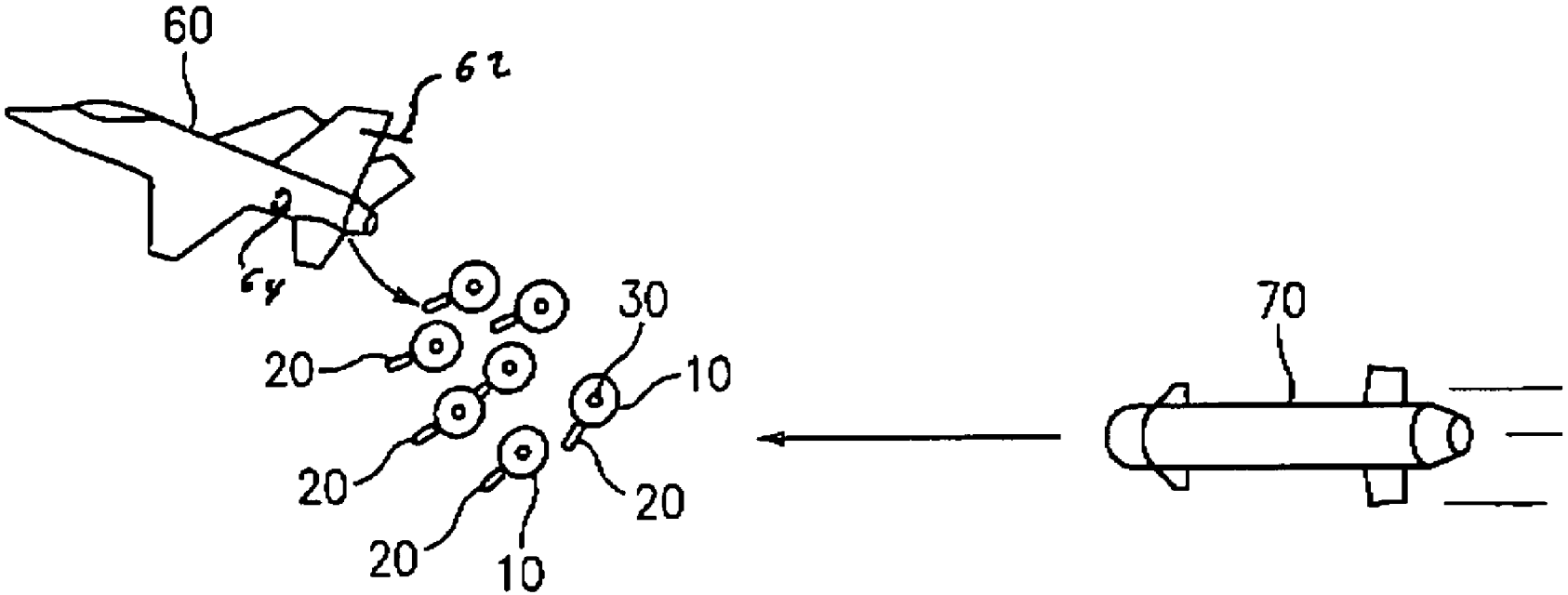
FIG. 4 shows the use the countermeasures of the present invention relieved from an aircraft.

With reference to FIG. 4, the present invention allows for the immediate release and activation of the countermeasure 10 by controller 64 when an incoming missile 70 has been detected by detector means 62. Preferably, these countermeasures 10 of the present invention provide an intense light source 30 that is either constant for a short period of time (e.g. up to several minutes or more) or will flash on and off in a regular manner (e.g. flashes about every second or so).

When a threat is detected, this system allows for these countermeasures to be released manually by the pilots or automatically by threat sensors coupled to the electronic controllers or other conventional electronic release means. Also, this system may be used in combination with other defense measures, such as flares or chaf. Moreover, the system can be activated during every take-off and landing automatically as the cost of these countermeasures is minimal. This automatic use of this system may eliminate the need for the extra (and very expensive electronics) to detect threatening missiles.

Figure 1:
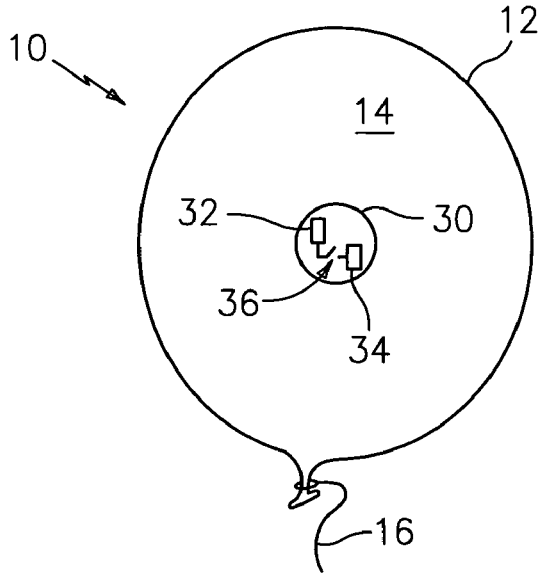
FIG. 1 shows one embodiment of a countermeasure of the present invention.

FIG. 1 illustrates one preferred embodiment of a countermeasure of the present invention, shown generally at 10, for preventing or impeding a guidance seeking device of a missile from tracking a target of interest. The countermeasure 10 includes a membrane 12 defining a pressurized gas-filled chamber 14 and an illuminating device 30. In one embodiment, the membrane 12 is formed from a polymeric material such as, for example, polyethylene terephthalate (commonly known as PET), or other polymeric materials such as, for example, materials sold under the brand names MYLAR® and KEVLAR® (registered trademarks of E.I. DuPont De Nemours and Company, Wilmington, Del. USA). The membrane 12 is at least partially transparent or translucent so that light illuminated from the illuminating device 30 (as described below) can be seen through the membrane 12.

Figure 3:
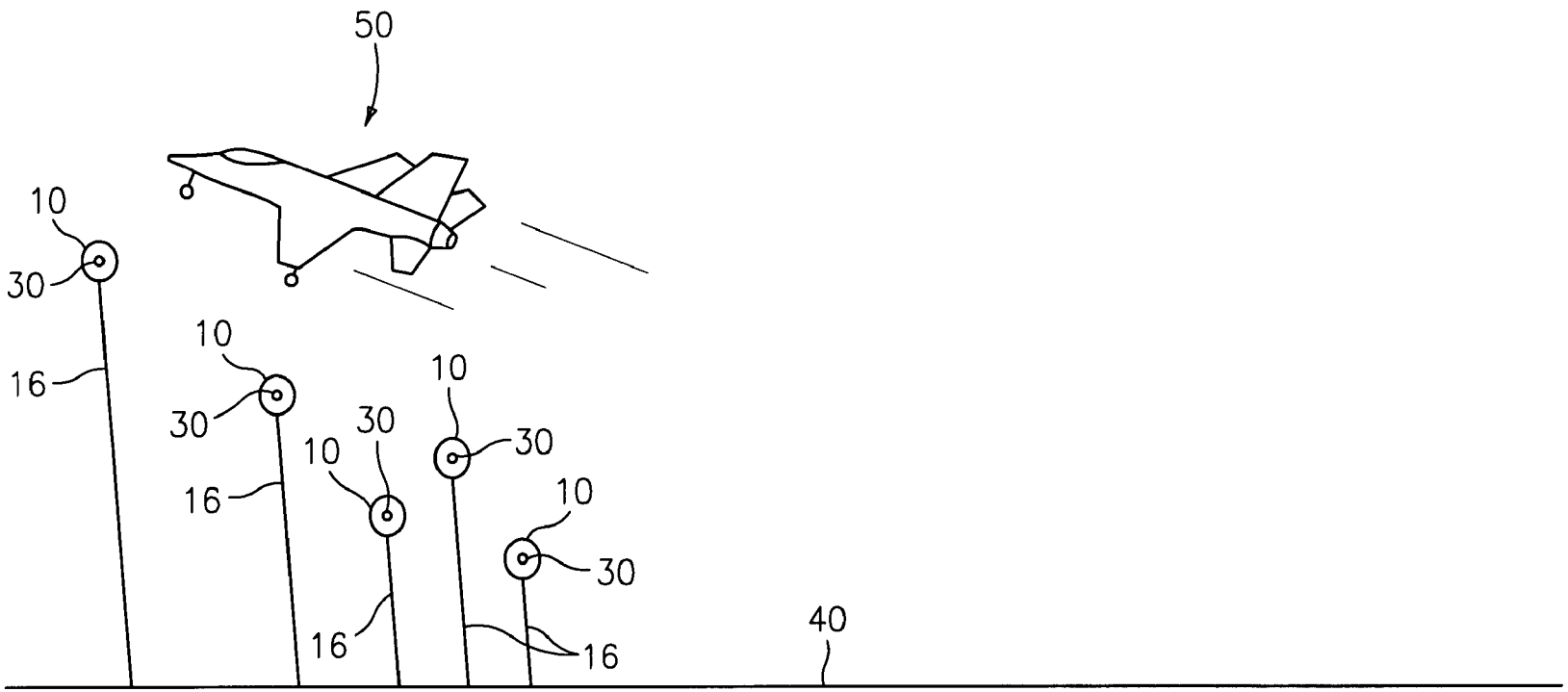
FIG. 3 shows the use of tethered countermeasures of the present invention at the end of an airport summary.

In one embodiment, the countermeasure 10 includes a tether 16 such as for example, a rope, cable or the like, for holding the countermeasure 10 in a position about an area of interest 40 such as, for example, a runway, flight deck or platform, or the like (FIG. 3). It should be appreciated that a number of such countermeasures 10 may be deployed about the area of interest 40 at various altitudes. When activated, the countermeasures 10 provide a number of decoy signals to substantially prevent a missile from targeting an aircraft, shown generally at 50, taking off from or landing at the area of interest 40. In another embodiment, the countermeasures of the present invention may be used to protect ground, amphibious and ocean-going vehicles from infra-red seeking missiles. In such cases, they may be released from the vehicles themselves or placed in intermittent locations like street lamps. Alternatively, they may be placed on tethers above such vehicles as well as placed around such vehicles in defensive positions, (either on tethers or on the ground.)

Figure 2A:
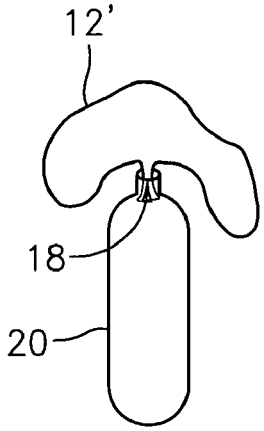
FIGS. 2A and 2B illustrate how this countermeasure is inflated.
Figure 2B:
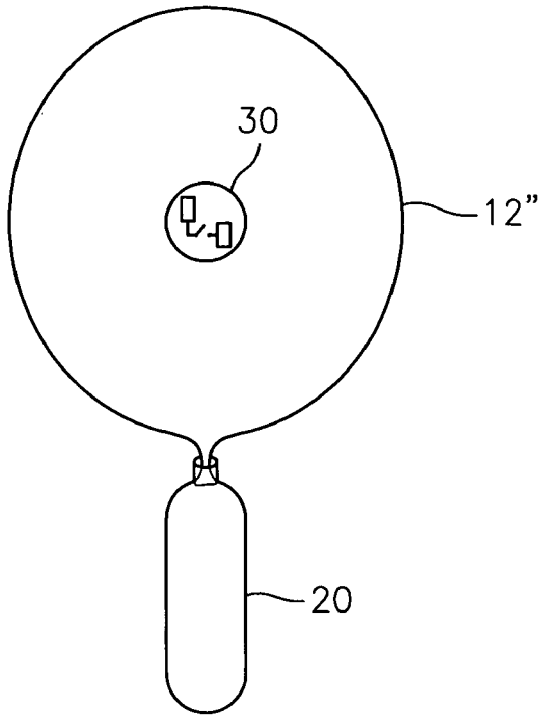

The chamber 14 is filled with a buoyant, "lighter-than-air" gas (e.g., a gas having a lesser density than air) such as, for example, helium, so that the countermeasure "floats" in air. In one embodiment, illustrated in FIGS. 2A and 2B, the countermeasure 10 is filled as it is being deployed. For example, a container 20 holding the buoyant gas is coupled to an opening 18 of the membrane (in a deflated state 12'). Upon deployment, the container 20 releases the buoyant gas through the opening 18 to fill the chamber 14 of the membrane 12". In one embodiment (FIG. 4), the container 20 is activated to release the gas as the countermeasure 10 is launched from an aircraft 60 into the path of an approaching missile 70.

In accordance with the present invention, the illuminating device 30 is sufficiently lightweight so as not to impact the ability of the countermeasure 10 from floating. In one embodiment, the illuminating device 30 includes a light source 32 such as, for example, a light emitting diode, electrically coupled to a power source 34 such as, for example, a battery. The light source 32 produces energy sufficient to provide a decoy signature detectable by the guidance seeking device of an air-to-air or surface-to-air missile. The illuminating device may be located inside the chamber or outside the chamber (e.g. either attached to chamber by a short tether or attached to the outer surface of the chamber). The overall countermeasure device is thus buoyant and will remain in position behind the aircraft for a reasonable time.

A control circuit 36 is employed to selectively activate the light source 32. In one embodiment, the control circuit 36 includes a switch that, when closed, couples the light source 32 to the power source 34. The switch may be closed as the countermeasure 10 is deployed, e.g., released from the aircraft 60 as illustrated in FIG. 4. In another embodiment, the control circuit 36 includes a timer for activating the countermeasure 10 (coupling the light source 32 and power source 34) at a predetermined time or in predetermined time intervals (e.g., a predetermined number of minutes). In yet another embodiment, the control circuit 36 includes a receiver for receiving activation signals provided by a transmitter, as is generally known in the art, located within, for example, a targeted aircraft deploying the countermeasure 10 while evading an approaching missile or located in, for example, an airport control tower activating a number of such countermeasures 10 as aircraft are taking off or landing.

While the aforementioned light source 32 is described above as including a light emitting diode, it should be appreciated that other light emitting material may equally be implemented. For example, the light source 32 may include a semiconductor device generally referred to as a laser diode, injection laser or diode laser. The semiconductor device produces coherent radiation (e.g., waves that all are of a same frequency and phase) in the visible or infrared (IR) spectrum. Further, the light source 32 could be a standard electronic flash apparatus similar to those used in photography. The light source 32 may be any suitable wavelength of light and, for some uses, may be a variable wavelength to cover a large section or the complete portion of the operating wavelength spectrum of missile guidance systems.

Although described in the context of preferred embodiments, it should be realized that a number of modifications to these teachings may occur to one skilled in the art. Accordingly, it will be understood by those skilled in the art that changes in form and details may be made therein without departing from the scope and spirit of the invention.

What is claimed is:

1. A process for protecting an aircraft during airport takeoffs and landings from infrared-seeking missiles, the process comprising the step of:

placing adjacent to an aircraft taking off or landing one or more countermeasures comprising a membrane defining an internal chamber, a gas having a lesser density than air disposed in said chamber, and an illuminating device, said illuminating device comprising (i) a light source effective to simulate an infrared radiation signature of an aircraft and (ii) a power supply coupled to said light source, wherein the countermeasures are used to provide a defensive decoy signature to protect the aircraft from infrared-seeking missiles.

2. The process of claim 1, wherein said one or more countermeasures includes a tether for positioning said countermeasure device about an area of interest.

3. The process of claim 1, wherein said one or more countermeasures include a container for storing said gas and a valve coupling said chamber and said container such that, when activated, said valve releases said gas from said container to fill said chamber.

4. The process of claim 1, wherein said light source is comprised of a light emitting diode.

5. The process of claim 1, wherein said light source is comprised of a laser diode.

6. The process of claim 1, wherein said illuminating device includes a control circuit for selectively coupling said light source to said power supply.

7. The process of claim 1, wherein said one or more countermeasures are tethered at a height positioning said one or more countermeasures above said aircraft.

8. The process of claim 1, wherein said illuminating device is located inside said chamber.

* * * * *